United States Patent [19]

Sobata et al.

[11] 4,256,601

[45] Mar. 17, 1981

[54] DEGREASING COMPOSITION FOR TREATING METAL SURFACE

[75] Inventors: Tamotsu Sobata, Sakai; Nobuo Nakatani, Kobe, both of Japan

[73] Assignee: Nippon Paint Co., Ltd., Osaka, Japan

[21] Appl. No.: 971,831

[22] Filed: Dec. 19, 1978

[30] Foreign Application Priority Data

Dec. 23, 1977 [JP] Japan ..... 52-155893

[51] Int. Cl.[3] ..... C11D 1/83; C11D 3/075

[52] U.S. Cl. ..... 252/135; 252/174.14; 252/174.19; 252/174.21; 252/174.22; 252/DIG. 14

[58] Field of Search ..... 134/40; 252/89, DIG. 1, 252/135, 174.14, 174.19, 174.21, 174.22; 568/609, 728

[56] References Cited

U.S. PATENT DOCUMENTS

| | | | |
|---|---|---|---|
| 2,213,477 | 9/1940 | Steindorff et al. | 568/609 |
| 2,630,457 | 3/1953 | Hansen et al. | 568/609 |
| 2,744,555 | 5/1956 | Nicholson et al. | 148/6.15 |
| 2,859,250 | 11/1958 | Woodbridge et al. | 568/609 |
| 3,062,749 | 11/1962 | Herrling | 252/170 |
| 3,511,882 | 5/1970 | Seale et al. | 568/609 |
| 3,536,529 | 10/1970 | Fiocco | 134/40 |
| 3,573,212 | 3/1971 | Ambros | 252/153 |
| 3,715,402 | 2/1973 | Louvar et al. | 568/609 X |
| 3,803,246 | 4/1974 | Rosenzweiz et al. | 568/609 |
| 3,810,786 | 5/1974 | Lindgren | 134/9 |
| 4,000,082 | 12/1976 | Orthalek et al. | 252/135 |
| 4,089,703 | 5/1978 | White | 134/22 |

FOREIGN PATENT DOCUMENTS

| | | | |
|---|---|---|---|
| 1935510 | 2/1971 | Fed. Rep. of Germany | 134/40 |
| 2505252 | 8/1975 | Fed. Rep. of Germany | 134/40 |

*Primary Examiner*—P. E. Willis, Jr.

*Attorney, Agent, or Firm*—Wenderoth, Lind & Ponack

[57] ABSTRACT

A degreasing composition for treating a metal surface in the form of an aqueous solution comprising as an essential ingredient a polynuclear phenol alkoxylate nonionic surfactant of the formula:

wherein X is hydrogen atom or hydroxy group; $R_1$ and $R_2$ are, the same or different, each hydrogen atom or methyl group; AO is an alkylene oxide group; and n is 3 to 20, and, optionally, a defoaming agent.

12 Claims, 1 Drawing Figure

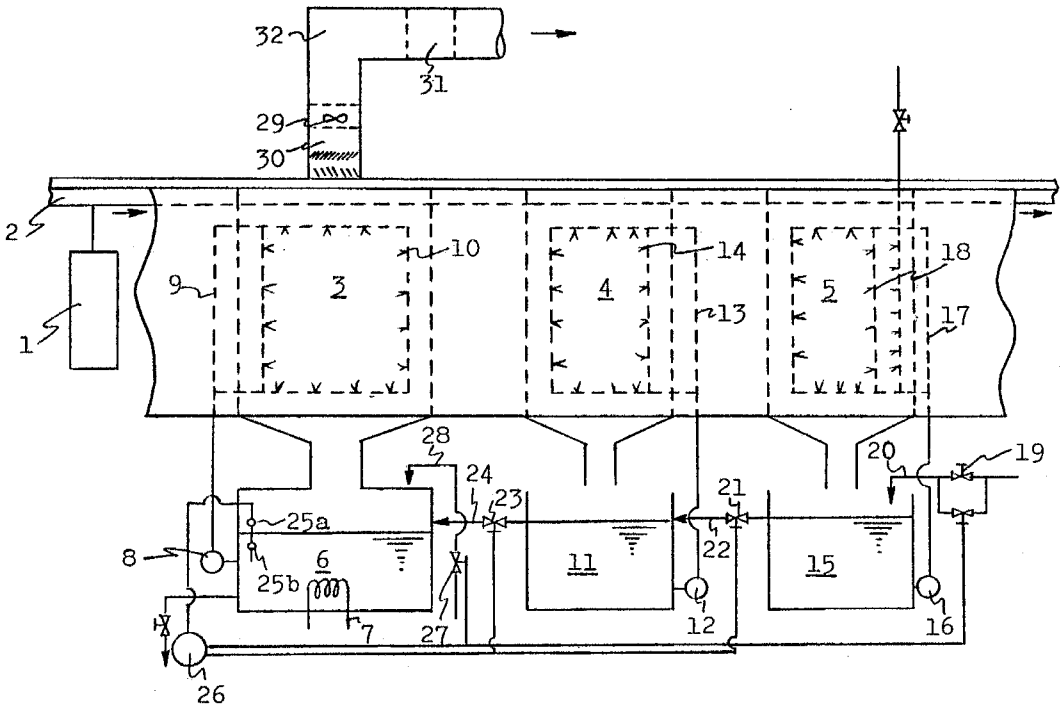
1
2
3
4
5
6
7
8
9
10
11
12
13
14
15
16
17
18
19
20
21
22
23
24
25a
25b
26
27
28
29
30
31
32

DEGREASING COMPOSITION FOR TREATING METAL SURFACE

BACKGROUND OF THE INVENTION

The present invention relates to a degreasing composition for treating a metal surface. More particularly, the composition of the present invention has a superior degreasing activity with extremely low foaming ability and, moreover, its degreasing activity is hardly deteriorated by a defoaming agent which is optionally added to the composition or fats and oils which adhere to the surface of the object to be treated and are carried into a degreasing bath or tank where the composition is used.

In the field of metal finishing, particularly, chemical conversion treatment of metal surfaces, there have been used various degreasing compositions for removing fats and oils (e.g mineral oils, animal oils, vegetable oils etc.) which adhere to the surface of the metal to be treated before the chemical conversion treatment. Generally, as such compositions, aqueous solutions containing as main ingredients a builder mainly composed of an acid or an alkali, and nonionic and/or anionic surfactants are used. These compositions can be used for treating metal surfaces with or without being diluted with water or the like. When a spray type metal surface treating equipment is used for degreasing or cleaning metal surfaces in metal finishing, foaming ability of a degreasing composition should be as low as possible.

There have been proposed various degreasing compositions having a low foaming ability.

For example, a certain surfactant which has a low foaming ability due to its specific structural formula is added to a degreasing composition. Examples of such surfactant are those described in Japanese Patent Publication No. 4373/1961 which are represented by the general formula:

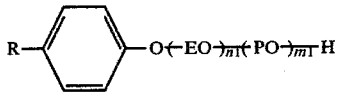

wherein R is an alkyl group; EO is ethylene oxide group; PO is propylene oxide group; and nl and ml are the number of moles of addition, respectively.

However, as the molar amount of the lipophilic group such as the propylene oxide group increases, not only does the foaming ability of the surfactant of the above structure decrease, providing a surfactant of sufficiently low foaming ability, but also its degreasing activity is lowered.

Further, degreasing compositions having a low foaming ability have usually been prepared by combining a hydrophilic surfactant which has strong degreasing activity and high foaming ability, and a lipophilic surfactant which has weak degreasing activity and low foaming ability. For example, a combination of a dialkylphenol alkylene oxide adduct and a higher fatty acid salt is disclosed in Japanese Patent Publication No. 4663/1968. A combination of an alkylphenol ethylene oxide adduct and a polypropylene glycol ethylene oxide adduct is also proposed.

However, in the above compositions, it is difficult to add a larger amount of the lipophilic surfactant having a low foaming ability, so as to lower the foaming ability of the composition, without deterioration of degreasing activity thereof.

Recently, for the purpose of preventing environmental pollution, a closed type metal surface treating equipment has been employed in a degreasing or cleaning process of metal finishing. When the degreasing or cleaning procedure is carried out in a closed type equipment, fats and oils which adhere to the surface of the metal to be treated can be collected in a degreasing bath or tank, where a degreasing composition is used, within a single system. The fats and oils thus collected in the tank can be removed with a suitable oil-water separator and then disposed of separately, by which environmental pollution can be prevented.

In a closed type metal surface treating equipment, it is also desirable to use a degreasing composition having a low foaming ability as described above. However, when a surfactant, particularly, a nonionic surfactant, is added to the degreasing composition, all or a part of the fats and oils in a degreasing tank are emulsified, and they cause deterioration of degreasing activity of the composition. There have been various attempts to restore the degreasing activity thus deteriorated but sufficient results have never been obtained.

For example, in one attempt, a concentration of a surfactant in a degreasing tank is made higher in order to restore the degreasing activity of the composition. However, this attempt results in significant foaming in the tank. Moreover, when a concentration of emulsified fats and oils (hereinafter, referred to as "emulsion-oil") in the tank becomes more than 5,000 ppm, it is difficult to sufficiently restore the degreasing activity and, eventually, the degreasing composition in the tank should be scrapped.

In another attempt, the degreasing activity is restored by destroying the emulsion-oil and then removing fats and oils. For example, it is described in Japanese Patent Publication (not examined) No. 91828/1976 to use an ultrafiltration equipment for this purpose. To use a centrifugal equipment is also disclosed in Japanese Patent Publication (not examined) No. 90934/1976. However, these attempts require a large cost for equipments and for complicated maintenance of the equipments.

Further, there is described another attempt in Japanese Patent Publication (not examined) No. 77269/1975. In this attempt, degreasing activity is restored by destroying emulsion-oil with an acid and then, after removing fats and oils, neutralizing with an alkali. However, this attempt also requires a large cost of the acid and alkali and further requires a filtration step which causes lowering of efficiency of the procedure.

SUMMARY OF THE INVENTION

Under these circumstances, we have intensively studied to obtain a degreasing composition having superior degreasing activity and extremely low foaming ability, and found that certain polynuclear phenol alkoxylate nonionic surfactants have specific properties which are useful in this regard. That is, they have an extremely poor foam stability and, moreover, they can efficiently separate oil from water in emulsion-oil. Additionally, we have also found that the above nonionic surfactants have stronger foam-breaking properties and that the foaming ability thereof becomes extremely low when they are combined with a defoaming agent.

One object of the present invention is to provide a degreasing composition for treating a metal surface which has a superior degreasing activity with extremely low foaming ability, and in which said degreasing activity is hardly deteriorated by a defoaming agent which is optionally added to the composition. Another object of the present invention is to provide a degreasing composition suitable for use in a closed type metal surface treating equipment for a degreasing or cleaning process in metal finishing. A further object of the invention is to provide a degreasing composition, the degreasing activity of which is hardly deteriorated by fats and oils which adhere to the surface of the metal to be treated and are carried into a degreasing bath or tank. These and other objects of the present invention will become apparent from the following description.

BRIEF DESCRIPTION OF THE DRAWING

The drawing represents a closed spray type apparatus for use in degreasing or cleaning metal surfaces with the degreasing composition of the present invention.

DETAILED DESCRIPTION OF THE INVENTION

The degreasing composition of the present invention comprises as an essential ingredient a polynuclear phenol alkoxylate nonionic surfactant.

The polynuclear phenol alkoxylate used in the present invention is a compound of the formula:

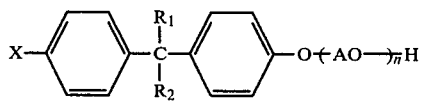

[I]

wherein X is hydrogen atom or hydroxy group; $R_1$ and $R_2$ are, the same or different, each hydrogen atom or methyl group; AO is an alkylene oxide group; and n is 3 to 20.

In the polynuclear phenol alkoxylate of the formula [I], all alkylene groups represented by AO may be hydrophilic ethylene oxide (EO) group, or they may be mixed groups of EO group(s) and one or more lipophilic groups for lowering foaming ability such as propylene oxide (PO) group, butylene oxide (BO) group or the like. Preferably, they are all EO groups. Where they are mixed groups, it is desirable that the ratio of EO groups to total AO groups is not less than 50 mol %.

The number of moles of AO addition (n) may be in the range of 3 to 20, preferably 5 to 15. When n is less than 3, HLB (hydrophilic-lipophilic balance) value of the compound becomes smaller and degreasing activity thereof is lowered due to its low water-solubility. On the other hand, when n is more than 20, HLB value of the compound becomes too large and degreasing activity thereof is also lowered due to its low emulsifying activity and low permeability to fats and oils. It is preferable that HLB value of the compound is within the range of 8 to 15.

Examples of the compound of the above formula [I] are those represented by the following formulae [Ia], [Ib] and [Ic]:

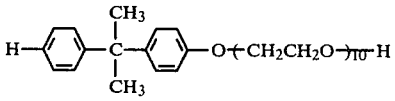

[Ia]

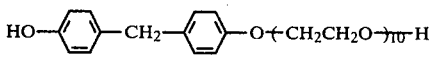

[Ib]

-continued

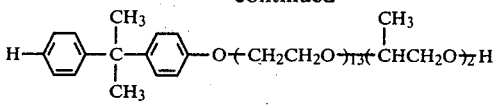

[Ic]

The compound of the formula [I] may be used singly or in a mixture of two or more kinds thereof in the degreasing composition.

The degreasing composition of the present invention may optionally be incorporated with a defoaming agent. The defoaming agent includes nonionic surfactants having a cloud point of not more than 40° C., or which are water-insoluble, for example, a higher alcohol having 10 to 20 carbon atoms, preferably 12 to 16 carbon atoms; an ether of a higher alcohol as mentioned above and a lower alcohol having 1 to 4 carbon atoms; an alkali metal salt (e.g. sodium or potassium salt) of a higher fatty acid having 10 to 20 carbon atoms, preferably 12 to 16 carbon atoms; and ester of a higher fatty acid as mentioned above with a lower alcohol having 1 to 4 carbon atoms; a higher fatty acid ethylene oxide adduct wherein the higher fatty acid is the same as mentioned above and the ethylene oxide addition molar number is not more than 10 (e.g. lauric acid ethylene oxide adduct having an ethylene oxide addition molar number of not more than 10); a higher alcohol alkylate having an HLB value of not more than 10, preferably, not more than 8, such as an ethylene oxide adduct (ethylene oxide addition molar number of not more than 5) of a primary alcohol having 12 to 13 carbon atoms, or an ethylene oxide adduct (ethylene oxide addition molar number of not more than 7) of a secondary alcohol having 12 to 14 carbon atoms; an alkylphenol alkylate having an HLB value of not more than 10, preferably not more than 8, such as nonylphenol ethylene oxide adduct having an ethylene oxide addition molar number of not more than 8.5, or octylphenol ethylene oxide adduct having an ethylene oxide addition molar number of not more than 8.0; polypropylene glycolpolyethylene glycol ether having an ethylene oxide content of not more than 20% by weight; or a mixture of two or more of these compounds. The amount of the defoaming agent to be added to the composition of the present invention can be suitably selected to attain the desired low foaming ability. Usually, the ratio of a compound of the formula [I] to the defoaming agent is 1:0.05 to 5 by weight. Mostly, a good result can be obtained within this range. Degreasing activity of the composition is hardly deteriorated in spite of adding the defoaming agent.

The degreasing composition of the present invention may further contain a suitable amount of one or more other ingredients such as a common builder, an organic solvent, an oxidizing agent, a titanium compound or the like. Particularly, it is preferable to add a builder since more improved degreasing activity can be obtained. Such a builder includes, for example, an inorganic acid such as phosphoric acid, sulfuric acid, nitric acid or the like; an organic acid such as citric acid, lactic acid, tartaric acid or the like; and an alkali such as alkali metal hydroxides (e.g. sodium hydroxide, potassium hydroxide), carbonates or bicarbonates (e.g. sodium carbonate, sodium bicarbonate, potassium carbonate, potassium bicarbonate), silicates (e.g. sodium metasilicate, sodium orthosilicate), phosphates (e.g. sodium phosphate), polyphosphates (e.g. sodium pyrophosphate, sodium tripolyphosphate), or the like.

The amounts of the ingredients in the degreasing composition of the present invention may vary with the kinds of the ingredients but may usually be as follows:

(A) When a builder is added to the composition:

Usually, a compound of the formula [I] is used in an amount from 0.001 to 1% by weight, preferably from 0.05 to 0.5% by weight, based on the total weight of the composition. If the amount of the compound is lower than 0.001% by weight, degreasing activity is insufficient and the separation of oil from water in emulsion-oil is also insufficient. On the other hand, if the amount of the compound is over 1% by weight, the composition can not practically be used since foaming ability thereof increases and a larger amount of a defoaming agent is required whereas no improved effect is observed.

In case of using a defoaming agent, the ratio of a compound of the formula [I] to the defoaming agent is usually 1:0.05 to 1 by weight, when the amount of the compound of the formula [I] is in a range of 0.001 to 0.1% by weight. When the amount of the compound of the formula [I] is 0.1 to 1% by weight, the ratio of the compound of the formula [I] to the defoaming agent may be 1:1 to 5 by weight. The most suitable ratio can be selected within the above range in accordance with the kinds of the specific metal surface treating equipment to be employed.

(B) When a builder is not added to the composition:

Usually, a compound of the formula [I] is used in an amount from 0.05 to 5% weight, preferably 0.1 to 1% by weight, based on the total weight of the composition. In case of using a defoaming agent, the ratio of a compound of the formula [I] to the defoaming agent is usually 1:0.05 to 5 by weight.

The degreasing composition of the present invention can be prepared by dissolving the above ingredients in an aqueous liquid carrier or diluent such as water or the like. The composition may be in the form of a concentrated solution or a diluted solution. In case of the concentrated solution, the ingredients are contained in higher amounts than those mentioned above, and the concentrated solution is appropriately diluted with water when used, so that the concentrations of the ingredients become within the ranges above-mentioned. The diluted solution containing suitable concentrations of the ingredients can be used as it is.

The degreasing composition of the present invention can be applied to metal surfaces according to conventional techniques, for example, the degreasing composition containing 1 to 10% by weight of the active ingredient(s) is applied to the metal surface at 40° to 80° C. for 1 to 30 minutes. The application may be carried out by dipping, spraying, brushing or the like. However, it is preferable to employ a closed spray type metal surface treating equipment in view of exhibiting the most desirable effects of the degreasing composition of the present invention. After being applied to the treatment of the metal surface at a comparatively low temperature (e.g. 40°-50° C.), the resulting composition is preferably heated at a temperature of 60° to 80° C. in order to accelerate the separation of oil therefrom and to decrease emulsion-oil in the composition.

The polynuclear phenol alkoxylate of the formula [I] can be prepared by alkoxylation of a polynuclear phenol (cf. Ber., Vol. 88, 1906(1955) and U.S. Pat. No. 2,468,982) by the process as disclosed in Japanese Patent Publication No. 4373/1961, and some of them are commercially available.

The present invention is illustrated by the following Examples, but is not limited thereto.

EXAMPLE 1

A degreasing composition was prepared by dissolving the compound of the above formula [Ia] (trade name: Adecanol PC-10, sold by Asahidenka Kogyo K.K.) in water to obtain an aqueous solution containing 0.1% by weight of the compound.

EXAMPLE 2

A degreasing composition was prepared by adding as a defoaming agent 0.05% by weight of a polypropylene glycol-polyethylene glycol ether (trade name: Pluronic L-61, produced and sold by Asahidenka Kogyo K.K.) to the aqueous solution obtained in Example 1.

COMPARATIVE EXAMPLE 1

A degreasing composition was prepared by dissolving nonylphenol ethoxylate (trade name: Emulgen 910, produced and sold by Kao Atlas K.K.) in water to obtain an aqueous solution containing 0.1% by weight of Emulgen 910.

COMPARATIVE EXAMPLE 2

A degreasing composition was prepared by adding 0.05% by weight of the defoaming agent as used in Example 2 to the aqueous solution obtained in Comparative Example 1.

Degreasing activity and foaming ability of the degreasing compositions of the above Examples 1 and 2 and Comparative Examples 1 and 2 were tested as follows:

Degreasing activity

A sheet of commercially available light dull finished steel plate (JIS G-3141, SPC-1, 70×150×0.8 mm) was dipped into the degreasing composition at 60° C. for 1 minute. After washing the treated steel plate with water, degreasing activity of the composition was evaluated by the wetting ratio (% by wet area to whole area of the plate) of the steel plate.

Foaming ability

Foaming ability of the composition was determined by measuring foam height (mm) according to Ross Miles method of JIS K-3362 at 40° C.

Results are shown in the following Table 1.

Table 1

| Test | | Example No. 1 | Example No. 2 | Comparative Example No. 1 | Comparative Example No. 2 |
|---|---|---|---|---|---|
| Degreasing activity (%) | | 97 | 83 | 88 | 10 |
| Foaming ability (mm) | immediately after initiation | 90 | 35 | 25 | 45 |
| | 1 min. later | 20 | 0 | 25 | 40 |

As is clear from Table 1, the degreasing compositions of the present invention (Examples 1 and 2) had superior degreasing activity and low foaming ability in comparison with the compositions of Comparative Examples 1 and 2. Further, no deterioration of degreasing activity due to addition of the defoaming agent was observed.

EXAMPLE 3

| Ingredients | Amounts |
|---|---|
| Compound of the above formula [Ia] | 1 g/l |
| The defoaming agent as used in Example 2 | 0.5 g/l |
| Sodium bicarbonate | 5 g/l |
| Sodium tertiary phosphate | 2.5 g/l |
| Water | up to 1 liter |

The ingredients were mixed and dissolved to obtain the degreasing composition of the present invention.

In the closed spray type metal surface treating equipment shown in the accompanying drawing, the degreasing composition was tested by continuously applying it for 1 month (8 hours/day) to degrease or clean automobile parts, to which mineral oils adhere. The test was carried out at 60° C., under a spray pressure of 2.0 kg/cm$^2$ for 1 minute.

In the drawing, automobile parts 1 are moved through spray chambers 3, 4 and 5 in turn by a conveyor 2. The degreasing composition is heated by a heater 7 in a degreasing tank 6, led to the chamber 3 via a pump 8 and a pipe 9 and sprayed through spray heads 10 in order to degrease or clean the parts 1. Then, in the chamber 4, washing water is sprayed through spray heads 14 in order to wash the parts 1, said washing water having been led to the chamber 4 via a pump 12 and a pipe 13 from a water tank 11. Further, in the chamber 5, the parts 1 are washed again by spraying washing water through spray heads 18, said washing water having been led to the chamber 5 via a pump 16 and a pipe 17 from a water tank 15.

The tank 15 is supplied with fresh water via a pipe 20 having a valve 19. Overflow water of the tank 15 is led to the tank 11 via a pipe 22 having a solenoid valve 21. Likewise, overflow water of the tank 11 is led to the tank 6 via a pipe 24 having a solenoid valve 23. In order to detect the liquid level in the tank 6, a liquid level-detecting means (consisting of a maximum level indicator 25*a* and a minimum level indicator 25*b*) is attached to the tank 6. The detecting means is connected to a controller 26. The controller 26 controls on-off operation of the solenoid valves 21 and 23 according to the directions of the indicators 25*a* and 25*b* to keep a constant liquid level in the tank 6. Moreover, the tank 6 is equipped with a pipe 28 having a solenoid valve 27 so as to supply the tank 6 with fresh water to maintain the desired liquid level, if necessary.

At the upper part of the chamber 3, there is an exhaust means 32 consisting of a fan 29, a vapor-liquid separator 30 and a condenser 31. Moisture evaporated in the chamber 3 is exhausted through the means 32. The volume of said moisture corresponds to the amount of water overflowing from the tank 11 to the tank 6.

During continuous operation for one month, fats and oils brought into the tank 6 floated on the degreasing composition with little emulsion-oil and they could be readily removed by a conventional static floating type oil-water separator. The active ingredients of the composition were appropriately added to the tank 6 to maintain degreasing activity thereof. The surface of the automobile parts thus treated were completely wetted. When the content of n-hexane extraction of the degreasing composition in the tank 6 was determined according to the method of JIS K-0102-1971, it was 1,800 ppm after completion of the treatment. Throughout the operation for one month, little foaming in the tanks 6, 11 and 15 was observed. When the composition thus used in the treatment was heated at 80° C. for 1 hour, emulsion-oil in the degreasing composition was decreased further, and the content of n-hexane extraction was 700 ppm after completion of the treatment.

COMPARATIVE EXAMPLE 3

The same procedure as in Example 3 was repeated except that the following composition was substituted for the degreasing composition of the present invention.

| Ingredients | Amounts |
|---|---|
| Nonylphenol ethoxylate in Comparative Example 1 | 1 g/l |
| Defoaming agent as used in Example 2 | 0.5 g/l |
| Sodium bicarbonate | 5 g/l |
| Sodium tertiary phosphate | 2.5 g/l |
| Water | up to 1 liter |

In the beginning, the composition exhibited good degreasing activity. However, fats and oils brought into the tank 6 were emulsified and thereby degreasing activity of the composition was deteriorated. When 500 ppm of nonylphenol ethoxylate was added to the tank so as to restore degreasing activity of the composition, a little restoration was observed. However, foaming became vigorous and overflow foaming in the tanks 6, 11 and 15 was observed. After 1 month, emulsion-oil in the composition amounted to 8,000 ppm as n-hexane extraction. The entire surface of the automobile parts repelled water after washing with water and the composition had to be scrapped.

What is claimed is:

1. A degreasing composition useful for treating a metal surface, comprising (1) a compound of the formula:

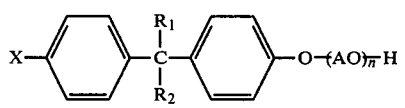

I wherein X is hydrogen or hydroxy, $R_1$ and $R_2$ are the same or different and each is hydrogen or methyl, AO is an alkylene oxide selected from the group consisting of ethylene oxide, propylene oxide and butylene oxide, at least 50 mol % of the total AO groups being ethylene oxide, and n is 3 to 20, which is dissolved in water, the amount of said compound of formula I being 0.001 to 5% by weight based on the total weight of the composition, and (2) a defoaming agent selected from the group consisting of a water-soluble nonionic surfactant having a cloud point of not more than 40° C. and a water-insoluble nonionic surfactant in an amount of 0.05 to 5 parts by weight per one part by weight of said compound of formula I.

2. A composition according to claim 1, wherein n is 5 to 15.

3. A composition according to claim 1, wherein said compound of formula I has an HLB value of 8 to 15.

4. A composition according to claim 1, wherein all of the AO groups are ethylene oxide groups.

5. A composition according to claim 1, wherein said compound of formula I is:

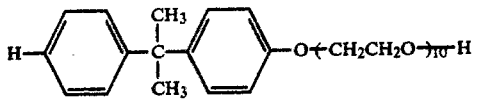

6. A composition according to claim 1, wherein said compound of formula I is:

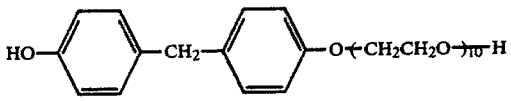

7. A composition according to claim 1, wherein said compound of formula I is:

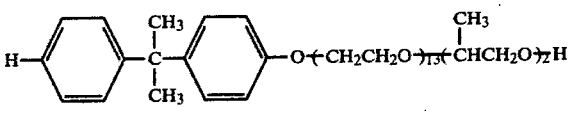

8. A composition according to claim 1, wherein the amount of said compound of formula I is 0.05 to 5% by weight based on the total weight of the composition.

9. A composition according to claim 1, wherein the defoaming agent is a member selected from the group consisting of an alcohol having 10 to 20 carbon atoms, an ether of an alcohol having 10 to 20 carbon atoms with an alcohol having 1 to 4 carbon atoms, an alkali metal salt of a fatty acid having 10 to 20 carbon atoms, an ester of a fatty acid having 10 to 20 carbon atoms with an alcohol having 1 to 4 carbon atoms, a fatty acid ethylene oxide adduct wherein the fatty acid has 10 to 20 carbon atoms and the ethylene oxide addition molar number is not more than 10, an alcohol alkylate having an HLB value of not more than 10, an alkylphenol alkylate having an HLB value of not more than 10, a polypropylene glycol-polyethylene glycol ether having an ethylene oxide content of not more than 20% by weight, and a mixture thereof.

10. A composition according to claim 1, wherein the amount of said compound of formula I is 0.001 to 1% by weight based on the total weight of the composition.

11. A composition according to claim 1, wherein the defoaming agent is a member selected from the group consisting of an alcohol having 10 to 20 carbon atoms, an ether of an alcohol having 10 to 20 carbon atoms with an alcohol having 1 to 4 carbon atoms, an alkali metal salt of a fatty acid having 10 to 20 carbon atoms, an ester of a fatty acid having 10 to 20 carbon atoms with an alcohol having 1 to 4 carbon atoms, a fatty acid ethylene oxide adduct wherein the fatty acid has 10 to 20 carbon atoms and the ethylene oxide addition molar number is not more than 10, an alcohol alkylate having an HLB value of not more than 10, an alkylphenol alkylate having an HLB value of not more than 10, a polypropylene glycol-polyethylene glycol ether having an ethylene oxide content of not more than 20% by weight, and a mixture thereof.

12. A composition according to claim 2, 3, 4, 5, 6, 7, 1, 10 or 11, wherein the composition further comprises a builder selected from the group consisting of phosphoric acid, sulfuric acid, nitric acid, citric acid, lactic acid, tartaric acid, an alkali metal hydroxide, an alkali metal carbonate, an alkali metal bicarbonate, an alkali metal silicate, an alkali metal phosphate and an alkali metal polyphosphate in an amount which is effective to improve the degreasing activity of the composition.

* * * * *